US011653758B1

(12) United States Patent
Wu et al.

(10) Patent No.: US 11,653,758 B1
(45) Date of Patent: May 23, 2023

(54) HOSPITAL HUMAN RESOURCE INFORMATION MANAGEMENT FILE CABINET

(71) Applicant: Union Hospital, Tongji Medical College, Huazhong University of Science and Technology, Wuhan (CN)

(72) Inventors: QingSong Wu, Wuhan (CN); YingCong Zhang, Wuhan (CN); Ming Ma, Wuhan (CN); Can Xiang, Wuhan (CN); Shi Chen, Wuhan (CN); JianCai Wu, Wuhan (CN); Yang Jin, Wuhan (CN); Zheng Wang, Wuhan (CN); Fei Luo, Wuhan (CN); ZhiHui Wang, Wuhan (CN)

(73) Assignee: Union Hospital, Tongji Medical College, Huazhong University of Science and Technology, Wuhan (CN)

( * ) Notice: Subject to any disclaimer, the term of this patent is extended or adjusted under 35 U.S.C. 154(b) by 0 days.

(21) Appl. No.: 18/104,538

(22) Filed: Feb. 1, 2023

(51) Int. Cl.
*A47B 63/00* (2006.01)
*F04D 25/08* (2006.01)

(52) U.S. Cl.
CPC ..... *A47B 63/00* (2013.01); *F04D 25/08* (2013.01); *A47B 2220/0091* (2013.01)

(58) Field of Classification Search
CPC .. A47B 63/00; A47B 2220/0091; F04D 25/08
USPC ..... 312/236
See application file for complete search history.

(56) References Cited

U.S. PATENT DOCUMENTS

2003/0223196 A1* 12/2003 Smith ..... H05K 7/1488 361/679.48
2013/0270984 A1* 10/2013 Chuda ..... A47B 67/04 312/348.3
2015/0145391 A1* 5/2015 Broome ..... H05K 5/0213 312/236
2017/0215620 A1* 8/2017 Dade ..... F25D 17/00

FOREIGN PATENT DOCUMENTS

CN 215076557 U 12/2021

OTHER PUBLICATIONS

CNIPA (WO/ISA), Written Opinion of the International Searching Authority (WO/ISA) for PCT/CN2022/121795, Dec. 15, 2022.

* cited by examiner

*Primary Examiner* — James O Hansen
(74) *Attorney, Agent, or Firm* — Zhigang Ma

(57) ABSTRACT

A hospital human resource information management file cabinet is provided, including a support base plate, a lower surface of which is fixedly connected to upper surfaces of three fan assemblies; left ends of the three fan assemblies are respectively connected to outer surfaces of three first conduits, and front ends of the three first conduits are in communication with back ends of three second conduits. The file cabinet speeds up air flow rate on surfaces of the files therein, prevents moisture causing damage to the files, reduces information loss, and continuously treats the moisture inside, which in turn guarantees the service life of the file cabinet.

9 Claims, 5 Drawing Sheets

HOSPITAL HUMAN RESOURCE INFORMATION MANAGEMENT FILE CABINET

CROSS-REFERENCING OF RELATED DISCLOSURE

The disclosure claims priority to Chinese patent application No. 202210125382.5 filed on Feb. 10, 2022 and entitled "Hospital Human Resource Information Management File Cabinet", the entire contents of which are incorporated herein by reference.

TECHNICAL FIELD

The disclosure relates to a technical field of information management, and more particularly to a hospital human resource information management file cabinet.

BACKGROUND

Personnel files of hospital employees are complex and numerous, which mainly results from a plurality of departments in the hospital, especially that each department is subdivided into a number of doctors, nurses and medical management staff. Therefore, the personnel files are classified to store in the file cabinet, so as to facilitate later examination, and the information stored in the personnel files is of great importance.

It is of great need to learn about a variety of information about the hospital while working in the hospital, which, however, requires checking a lot of data. Therefore, an amount of the files about human resources is considerable, and if these files are treated randomly, working efficiency of the staff must decrease significantly. In addition, if these files are lost, it is a serious loss for the hospital.

With an increase of information age, global business environment is changing rapidly, each industry is facing huge challenges, and human resources are especially at the tip of the storm. The flow of people in the hospital is large, so human resource information management work is not easy, which needs to be managed with a help of a special file cabinet. The structure of the existing hospital human resource information management file cabinet is single, however, the hospital needs to be sprayed disinfection water all year round, and the file cabinet will be moist inside during its usage. Furthermore, the human resource information are stored in the moist file cabinet for a long time, resulting in the human resource information to be damp, which not only causes the loss of information, but also causes rust and corrosion to the body of the file cabinet, and thereby to shorten the service life of the file cabinet, resulting in a certain economic loss.

SUMMARY

Based on the above problems, the disclosure provides a hospital human resource information management file cabinet.

The hospital human resource information management file cabinet of the disclosure includes: a support base plate; three fan assemblies, upper surfaces of which are fixedly connected to a bottom surface of the support base plate; three first conduits, outer surfaces of which are respectively in communication with ends of the three fan assemblies; three second conduits, back ends of which are respectively in communication with front ends of the three first conduits;

three third conduits, bottom ends of which are respectively in communication with front ends of the three second conduits; and three first sealed covers, front surfaces of which are respectively in communication with front ends of the three third conduits and back surfaces of which are fixedly disposed on a front surface of the support base plate. The front surface of the support base plate is provided with a plurality of ventilation slots, through which the three first sealed covers are in communication with the support base plate; a plurality of positioning bumps are provided on an upper surface of the support base plate; and a plurality of slide holes are respectively provided on back surfaces of the plurality of positioning bumps, through which the plurality of positioning bumps are in communication with the plurality of ventilation slots. Reset springs are provided on back surfaces of inner walls of the plurality of ventilation slots; a front end of each of positioning rods is fixedly connected to a back end of a corresponding one of the reset springs, and each the positioning rod is slidably disposed in a corresponding one of the plurality of slide holes; file cabinets are slidably provided on the upper surface of the support base plate, and a bottom surface of each of the file cabinets is provided with a plurality of limit strips.

The present disclosure provides the hospital human resource information management file cabinet, which is provided with fan assemblies, file cabinets, control switches, second sealed covers, first connection pipes and first conduits. Therefore, when the fan assemblies inject air into the file cabinets through the first connection pipes, the air will speed up ventilation inside, and accelerate air circulation inside, which avoids moisture accumulation causing damage to the file cabinets. At the same time, when the file cabinets need to be turned on to remove its internal files, what is only to be done is to activate the control switches disposed on the front surfaces of the file cabinets, so that the control switches are capable of turning on the corresponding control valves. Then, at this time, the control valves are activated under the signals of the control switches, so the air emitted by the fan assemblies will enter the file cabinets along the control valves that has been activated, and with an entry of the air, file drawers of the file cabinets are squeezed by the air, thereby to be slowly discharged from the file cabinets. As the file drawers slide, upper cover plates are turned over driven by coil springs. At this time, the files inside the file drawers can be removed, which improves the actual use effect of the file cabinets. In addition, the air enters the file drawers through the surfaces of the upper cover plates, which can speed up the air flow rate on the surface of the files, to avoid causing damage to the files due to moisture, and reduce the loss of data. Furthermore, the first connection pipes are connected to the fan assemblies for a long time, so that the fan assemblies can continuously treat the moisture inside the file cabinets, and thus ensuring the service life of the file cabinets.

The present disclosure is provided with first sealed covers, first conduits and second conduits, when the fan assemblies extracts the air through the third sealed covers, the fan assemblies then inject the air into the first sealed covers and the first connection pipes through the first conduits and the second conduits respectively, so that when the air enters the first sealed covers, the air will then enter the slide holes through the positioning bumps. At this time, due to the continuous operation of the fan assemblies, the air pressure in the slide holes rises rapidly to push the positioning rods in the slide holes move backward along the slide holes under the air pressure. Furthermore, the position of the file cabinets need to be adjusted at this time, and the positioning holes disposed on the front surfaces of the limit strips at the bottom of the file cabinets are aligned with the positioning rods to fix the file cabinets. Therefore, the staff can easily install or dismantle a certain file cabinet during actual use, and it is possible to avoid the file cabinets deviating or even dumping resulting from a collision or squeeze while using, which guarantees the stability of the file cabinets after assembling and improves the safety of the file cabinets while using them.

DESCRIPTION OF REFERENCE NUMERALS

Figure 1:
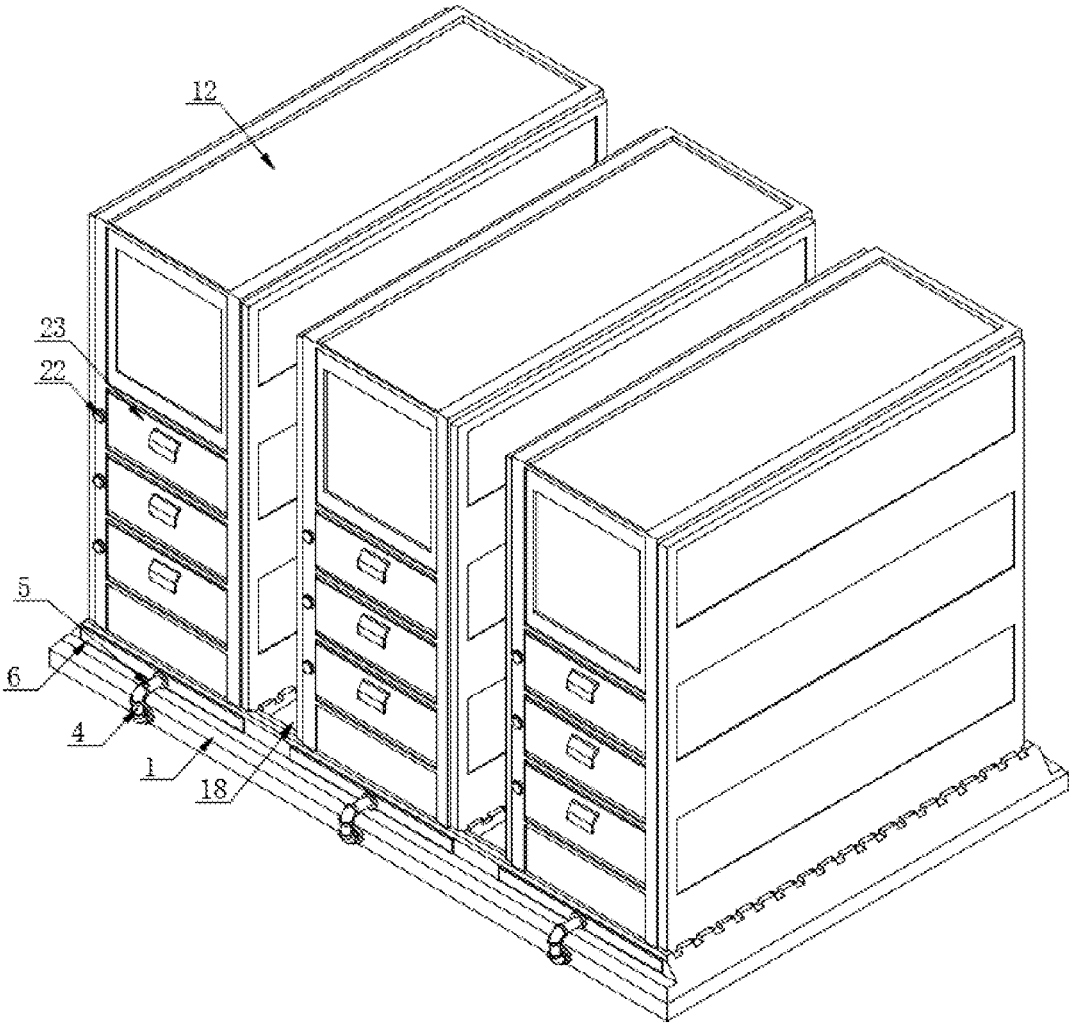
FIG. 1 illustrates a schematic structural diagram of a hospital human resource information management file cabinet according to an embodiment of the disclosure.

1—support base plate; 2—fan assembly; 3—first conduit; 4—second conduit; 5—third conduit; 6—first sealed cover; 7—ventilation slot; 8—positioning bump; 9—slide hole; 10—reset spring; 11—positioning rod; 12—file cabinet; 13—exhaust pipe; 14—connection head; 15—first connection pipe; 16—control valve; 17—second sealed cover; 18—air inlet; 19—third sealed cover; 20—second connection pipe; 21—filter box; 22—control switch; 23—sealed door plate; 24—file drawer; 25—partition plates; 26—pin shaft; 27—coil spring; 28—upper cover plate; 28—through hole; 30—slide slot.

DETAILED DESCRIPTION OF EMBODIMENTS

As shown in FIGS. 1-6, the present disclosure provides a hospital human resource information management file cabinet, including a support base plate 1, three fan assemblies 2, three first conduits 3, three second conduits 4, three third conduits 5, three first sealed covers 6, a plurality of ventilation slots 7, a plurality of positioning bumps 8, a plurality of slide holes 9, reset springs 10, positioning rods 11, and file cabinets 12. Upper surfaces of the three fan assemblies 2 are fixedly connected to a bottom surface of the support base plate 1; outer surfaces of the three first conduits 3 are in communication with ends of the three fan assemblies 2 respectively; back ends of the three second conduits 4 are in communication with front ends of the three first conduits 3 respectively; bottom ends of the three third conduits 5 are in communication with another ends of the three second conduits 4 respectively; front surfaces of the three first sealed covers 6 are in communication with another ends of the three third conduits 5 respectively and back surfaces of the three first sealed covers 6 are fixedly disposed on a front surface of the support base plate 1; the front surface of the support base plate 1 is provided with the plurality of ventilation slots 7, the three first sealed covers 6 are in communication with the support base plate 1 through the plurality of ventilation slots 7; the plurality of positioning bumps 8 are fixedly disposed on an upper surface of the support base plate 1; back surfaces of the plurality of positioning bumps 8 are provided with the plurality of slide holes 9 respectively, the plurality of positioning bumps 8 are in communication with the plurality of ventilation slots 7 through the plurality of slide holes 9; each reset spring 10 is fixedly connected to a back surface of an inner wall of one of the plurality of ventilation slots 7; each positioning rod 11 is slidably disposed in a corresponding one of the plurality of slide holes 9, a front end of which is fixedly connected to a back end of the reset spring 10; and the file cabinets 12 are slidably connected to the upper surface of the support base plate 1, a bottom surface of each file cabinet 12 is provided with a plurality of limit strips. The fan assemblies 2, the file cabinets 12 and the control switches 22 facilitate an actual use of the hospital human resource information management file cabinet. Furthermore, the air enters into the file cabinets 12 through the surfaces of the upper cover plates 28, which can speed up the air flow rate on the surface of the files, to avoid damage to the files due to the moisture, and reduce the loss of information. In addition, the first connection pipes 15 are always connected to the fan assemblies 2, so that the fan assemblies 2 can continuously deal with the moisture inside the file cabinets 12, and thus the service life of the hospital human resource information management file cabinet of the disclosure is guaranteed.

As shown in FIG. 1, FIG. 3, FIG. 4 and FIG. 5, an end of each of the three fan assemblies 2 is configured as an exhaust end, an opposite end of each of the three fan assemblies 2 is configured as an air inlet end, and the number of the file cabinets 12 is three. A plurality of positioning holes are disposed on a front surface of each of the plurality of limit strips, which are disposed on the bottom surface of the file cabinet 12, and the positioning rod 11 is correspondingly snap connected to the positioning hole, which is disposed on the front surface of the limit strip that is disposed on the bottom surface of the file cabinet 12. The hospital human resource information management file cabinet of the disclosure is provided with the first sealed covers 6 and the first conduits 3 to make the positioning holes disposed on the front surfaces of the limit strips at the bottom of the file cabinets 12 align with the positioning rods 11, thereby to fix the file cabinets 12. Therefore, the staff can easily install or dismantle a certain file cabinet 12 during actual use, and it is possible to prevent the hospital human resource information management file cabinet deviating or even dumping resulting from a collision or squeeze while using, to guarantee the stability after assembling and to improve the safety during the actual use. Back surfaces of the file cabinets 12 are fixedly connected to front surfaces of second sealed covers 17, and a back surface of one of the second sealed covers 17 is fixedly connected with three control valves 16. The three control valves 16 are in communication with the file cabinet 12 through the corresponding second sealed cover 17, and the other ends of the three control valves 16 are connected to front ends of three connection heads 14 respectively. The back ends of the first conduits 3 are in communication with front ends of exhaust pipes 13, and the three connection heads 14 are in communication with air delivery pipes. The hospital human resource information management file cabinet of the disclosure is provided with the control valves 16, therefore, the staff can make the air enter into the file cabinets 12 through the control valves only by adjusting the control switches 22, which reduces the difficulty of extracting the file drawers 24, and at the same time, improves the convenience of the use of the file cabinet.

Figure 2:
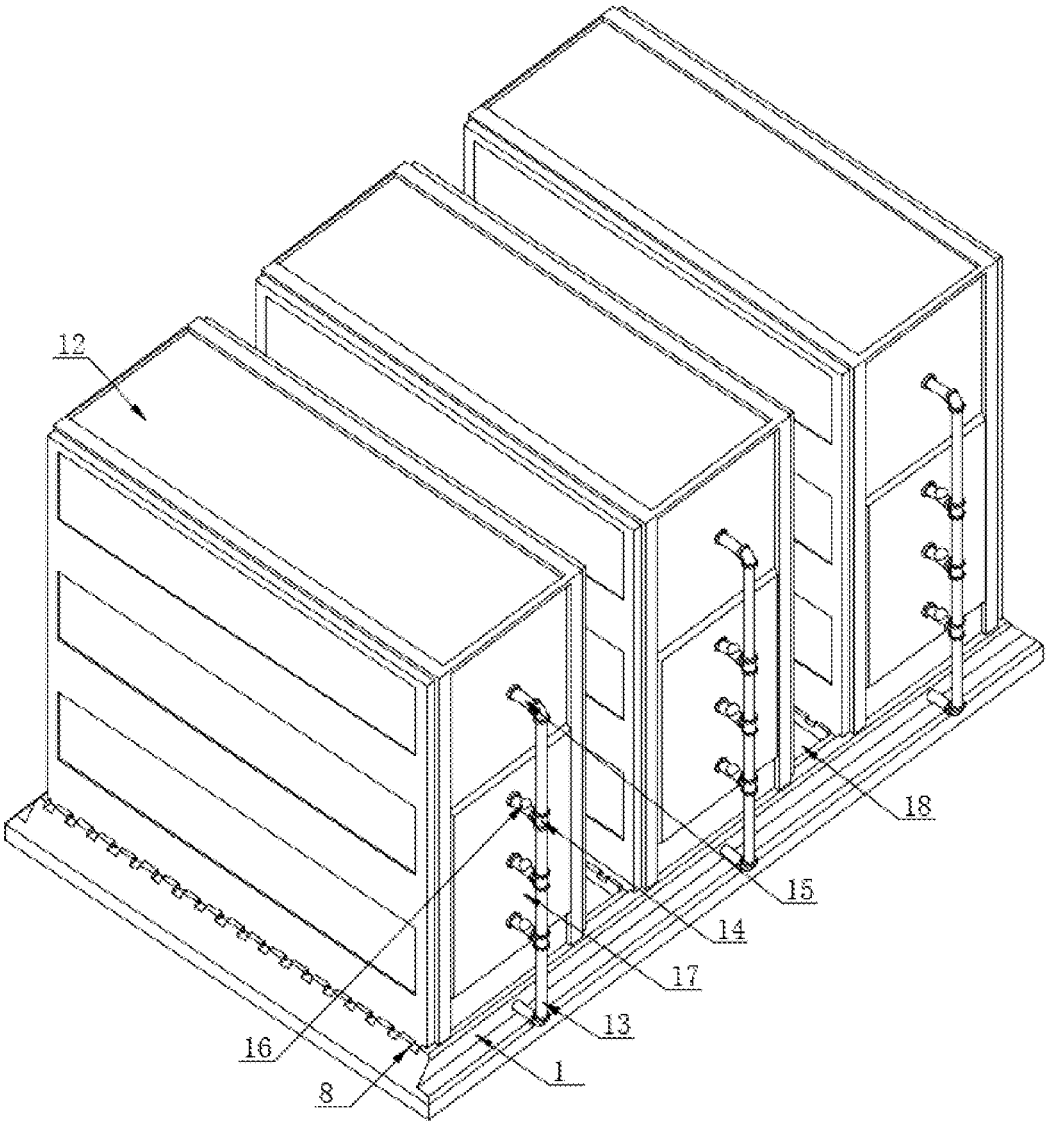
FIG. 2 illustrates a schematic structural diagram of the hospital human resource information management file cabinet in another view of FIG. 1 according to the embodiment of the disclosure.
Figure 4:
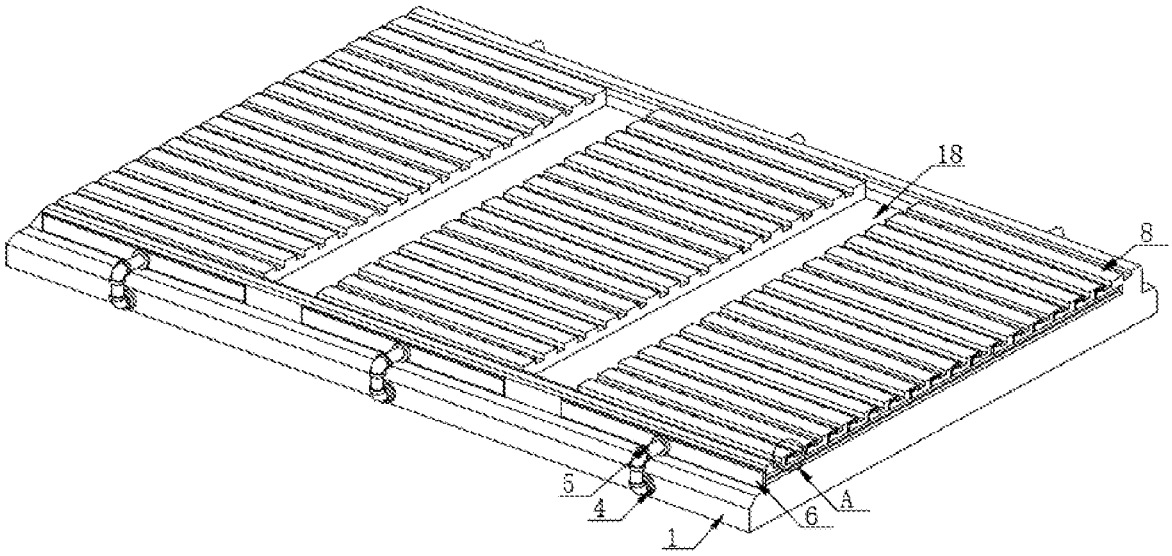
FIG. 4 illustrates a schematic structural diagram of a section of FIG. 3 according to an embodiment of the disclosure.
Figure 5:
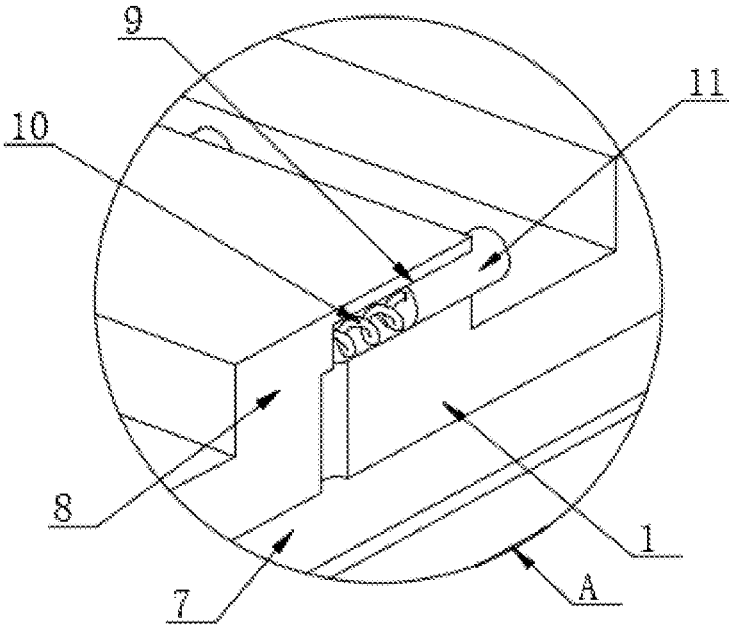
FIG. 5 illustrates an enlarged structural schematic diagram of a part A in FIG. 4 according to an embodiment of the disclosure.

As shown in FIG. 2, FIG. 4 and FIG. 5, two air inlets 18 are disposed in the upper surface of the support base plate 1, two third sealed covers 19 are fixedly disposed on the bottom surface of the support base plate 1, the two third sealed covers 19 are respectively disposed below the corresponding two air inlets 18, and bottom surfaces of the two third sealed covers 19 are respectively in communication with top ends of the two second connection pipes 20. Further, left surfaces of two filter boxes 21 are correspondingly in communication with another ends of the two second connection pipes 20. The hospital human resource information management file cabinet of the disclosure is provided with the filter boxes 21, which can effectively deal with the moisture on its surface while extracting the outside air. At the same time, the filter boxes 21 can also deal with the collected outside air to avoid the rusting situation of the file cabinets 12, which results from the excessive humidity of the injected air when the fan assemblies 2 inject the air into the file cabinets 12. Upper surfaces of the two filter boxes 21 are fixedly connected to the bottom surface of the support base plate 1, and right surfaces of the two filter boxes 21 are correspondingly in communication with another ends of two of the three fan assemblies 2.

Figure 3:
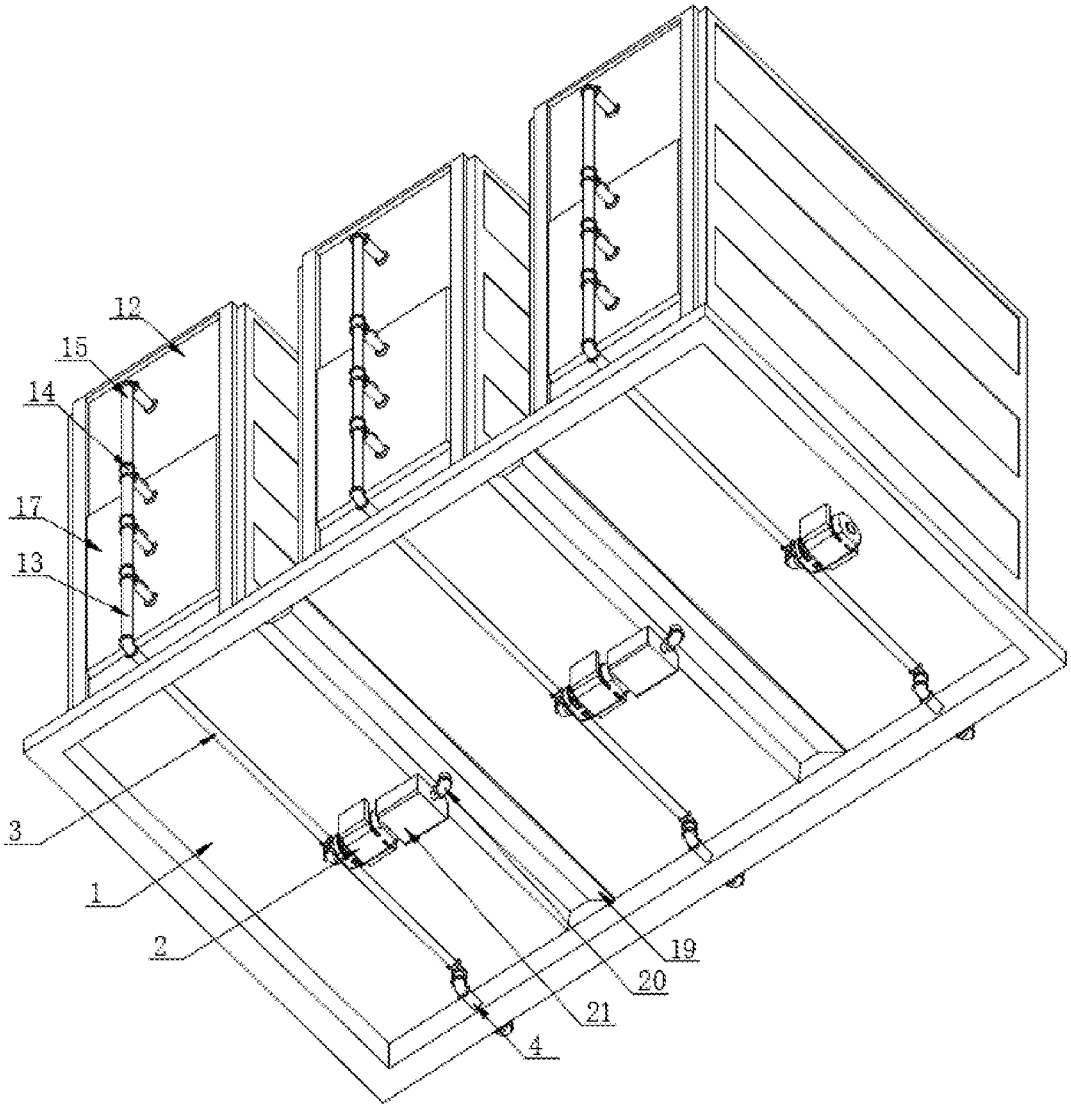
FIG. 3 illustrates a schematic structural diagram of a support base plate in FIG. 1 according to an embodiment of the disclosure.
Figure 6:
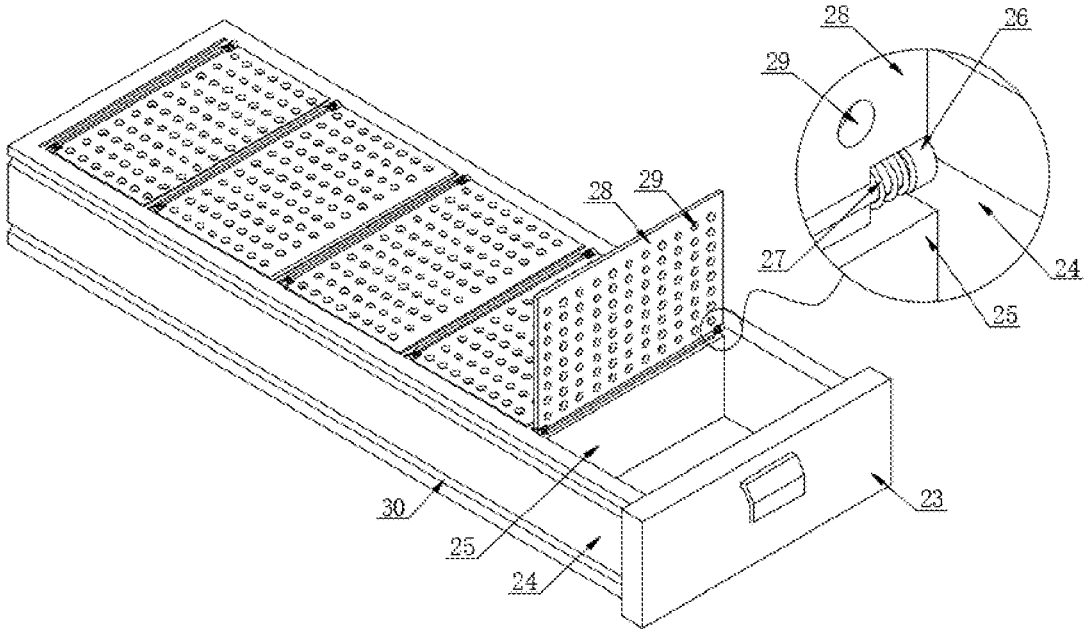
FIG. 6 illustrates a three-dimensional schematic structural diagram of a sealed door plate in FIG. 1 according to an embodiment of the disclosure.

As shown in FIG. 2, FIG. 3 and FIG. 6, one of the three file cabinets 12 is provided with three sealed door plates 23 on its front surface, and there are file drawers 24 fixedly provided on back surfaces of the three sealed door plates 23, specially that a back surface of each of the three sealed door plates 23 is fixedly provided with a corresponding file drawer 24. An inner wall of the file drawer 24 is fixedly provided with a plurality of partition plates 25, and there are a plurality of pin shafts 26 fixedly connected to left and right surfaces of the file drawer 24, the pin shafts 26 are disposed above the plurality of the partition plates 25, and outer surfaces of the plurality of the pin shafts 26 are sleeved with coil springs 27, specially that an outer surface of each of the plurality of the pin shafts 26 is sleeved with the two coil springs 27. Two ends of each of the coil springs 27 are fixedly connected to an outer surface of one of the plurality of partition plates 25 and a front surface of one of a plurality of upper cover plates 28. The hospital human resource information management file cabinet is provided with the coil springs 27, which can make the corresponding file drawer 24 slide out of the corresponding file cabinet 12 under the air pressure, at this time, the two coil springs 27 drive the corresponding one pin shaft 26 and the corresponding one upper cover plate 28 to turn over, so that the upper cover plate 28 turns over quickly along the pin shaft 26. Meanwhile, when the file drawer 24 is withdrawn, the upper cover plate 28 drives the two coil springs 27 to rotate, thereby to make the two coil springs 27 accumulate pressure, and thus reducing the difficulty of using the hospital human resource information management file cabinet. Each of the upper cover plates 28 is provided with a plurality of through holes 29, a bottom surface of each the upper cover plate 28 is fixedly connected to the outer surface of the corresponding one of the plurality of pin shafts 26, each the upper cover plate 28 is hinged to the file drawer 24 through the corresponding pin shaft 26, left and right surfaces of the file drawer 24 are provided with sliding slots 30, and the file drawer 24 is slidably disposed in the corresponding file cabinet 12 through the sliding slots 30. A plurality of control switches 22 are provided on a front surface of each the file cabinet 12, and an output end of each of the plurality of control switches 22 is electrically connected to an input end of a corresponding one of the three control valves 16.

Working principles of the hospital human resource information management file cabinet of the disclosure are as follows. When the hospital human resource information management file cabinet is in the use state, the fan assembly 2 is turned on to extract the air above the air inlet 18 through the filter box 21, the third sealed cover 19 and the second connection pipe 20. When the air flows into the third sealed cover 19 through the air inlet 18, air flow rate on the surface of the file cabinet 12 is accelerated; therefore, the moisture inside the file cabinet 12 slowly evaporates under the high-speed air flow rate. At the same time, when the air is extracted, the filter box 21 deals with the moisture contained in the air. When the fan assembly 2 extracts the air through the third sealed cover 19, the fan assembly 2 injects the air into the first sealed cover 6 and the first connection pipe 15 through the first conduit 3 and the second conduit 4 respectively, so that when the air enters the first sealed cover 6, the air enters the slide hole 9 through the positioning bump 8, at this time, due to the continuous operation of the fan assembly 2, air pressure in the slide hole 9 rises rapidly to push the positioning rod 11 in the slide hole 9 to move backward along the slide hole 9, at which the position of the file cabinet 12 needs to be adjusted, namely, the file cabinet 12 is fixed by aligning the positioning hole disposed on the front surface of the limit strip at the bottom of the file cabinet 12 with the positioning rod 11. When the air enters the file cabinet 12 through the first connection pipe 15, the air then speeds up the air flow rate inside the file cabinet 12, and accelerates the air circulation inside the file cabinet 12, which avoids causing damage to the file cabinet 12 resulted from the moisture accumulation. Furthermore, when it is necessary to open the file cabinet 12 to take out the inside files, it is only necessary to activate the control switch 22 disposed on the front surface of the file cabinet 12, so that the control switch 22 activate the corresponding control valve 16. Then, the control valve 16 is activated under the signals of the control switch 22, the air discharged from the fan assembly 2 enters the file cabinet 12 along the activated control valve 16, and the air enters the file drawer 24 next, so the file drawer 24 is squeezed by the air and slowly discharged from the file cabinet 12. As the file drawer 24 slides, the upper cover plate 28 is flipped driven by the two coil springs 27, and then the files inside the file drawer 24 are taken out.

The embodiments described above are the illustrated embodiments of the disclosure, and are only used to facilitate the descriptions of the disclosure, not to limit the disclosure in any form. For any skilled in the related art, if an equivalent embodiment is made by using the technical solutions disclosed in the disclosure with partial alterations or modifications, within the scope of the technical solutions mentioned in the disclosure, and without departing from the content of the technical solutions of the disclosure, it still falls within the scope of the protection of the disclosure.

What is claimed is:

1. A hospital human resource information management file cabinet, comprising:

a support base plate;

three fan assemblies, wherein upper surfaces of the three fan assemblies are fixedly connected to a bottom surface of the support base plate;

three first conduits, wherein outer surfaces of the three first conduits are in communication with ends of the three fan assemblies, respectively;

three second conduits, wherein back ends of the three second conduits are in communication with front ends of the three first conduits, respectively;

three third conduits, wherein bottom ends of the three third conduits are in communication with front ends of the three second conduits, respectively;

three first sealed covers, wherein front surfaces of the three first sealed covers are in communication with front ends of the three third conduits respectively, and back surfaces of the three first sealed covers are fixedly disposed on a front surface of the support base plate; the front surface of the support base plate is provided with a plurality of ventilation slots, the three first sealed covers are in communication with the support base plate through the plurality of ventilation slots;

a plurality of positioning bumps, provided on an upper surface of the support base plate, wherein back surfaces of the plurality of positioning bumps are provided with a plurality of slide holes respectively, and the plurality of positioning bumps are in communication with the plurality of ventilation slots through the plurality of slide holes;

reset springs, wherein each of the reset rings is provided on a back surface of an inner wall of each of the plurality of ventilation slots;

positioning rods, wherein a front end of each of the positioning rods is fixedly connected to a back end of a corresponding one of the reset springs, and each the positioning rod is slidably disposed in a corresponding one of the plurality of slide holes; and file cabinets, slidably provided on the upper surface of the support base plate; wherein a bottom surface of each of the file cabinets is provided with a plurality of limit strips.

2. The hospital human resource information management file cabinet according to claim 1, wherein an end of each of the three fan assemblies is configured as an exhaust end, and an opposite end of each of the three fan assemblies is configured as an air inlet end; the number of the file cabinets is three; and a plurality of positioning holes are disposed on a front surface of each of the plurality of limit strips disposed on the bottom surface of each the file cabinet, and the plurality of positioning rods are snap connected with the plurality of positioning holes of each the limit strip respectively.

3. The hospital human resource information management file cabinet according to claim 1, wherein back surfaces of the three file cabinets are fixedly connected with front surfaces of three second sealed covers respectively, a back surface of each of the three second sealed covers is fixedly connected with three control valves, the three control valves are in communication with one of the three file cabinets through the second sealed cover, and ends of the three control valves are connected to front ends of three connection heads respectively.

4. The hospital human resource information management file cabinet according to claim 3, wherein back ends of the three first conduits are in communication with front ends of three exhaust pipes respectively, and the three connection heads are in communication with one another through air gas delivery pipes, a bottom end of a lower connection head of the three connection heads is in communication with a top end of one of the three exhaust pipes, a top end of an upper connection head of the three connection heads is in communication with a bottom end of one of three first connection pipes, and another ends of the three first connection pipes are in communication with the back surfaces of the three file cabinets.

5. The hospital human resource information management file cabinet according to claim 4, wherein a front surface of each of the three file cabinets is provided with a plurality of control switches, and an output end of each of the plurality of control switches is electrically connected to an input end of a corresponding one of the three control valves.

6. The hospital human resource information management file cabinet according to claim 1, wherein two air inlets are disposed in the upper surface of the support base plate, two third sealed covers are fixedly disposed on the bottom surface of the support base plate, the two third sealed covers are respectively disposed below the corresponding two air inlets, and bottom surfaces of the two third sealed covers are respectively in communication with top ends of two second connection pipes.

7. The hospital human resource information management file cabinet according to claim 6, wherein left surfaces of two filter boxes are correspondingly in communication with another ends of the two second connection pipes, upper surfaces of the two filter boxes are fixedly connected to the bottom surface of the support base plate, and right surfaces of the two filter boxes are correspondingly in communication with another ends of two of the three fan assemblies.

8. The hospital human resource information management file cabinet according to claim 1, wherein a front surface of each of the three file cabinets is provided with three sealed door plates, a back surface of each of the three sealed door plates is fixedly provided with a file drawer, a plurality of partition plates are fixedly connected to an inner wall of the file drawer, a plurality of pin shafts are fixedly connected to left and right surfaces of the file drawer, the plurality of pin shafts are disposed above the plurality of partition plates, and outer surfaces of the plurality of pin shafts are sleeved with coil springs.

9. The hospital human resource information management file cabinet according to claim 8, wherein two ends of each of the coil springs are fixedly connected to an outer surface of one of the plurality of partition plates and a front surface of one of a plurality of upper cover plates, a front surface of each of the plurality of upper cover plates is provided with a plurality of through holes, a bottom surface of each the upper cover plate is fixedly connected to the outer surface of a corresponding one of the plurality of pin shafts, each the upper cover plate is hinged to the file drawer through the corresponding pin shaft, left and right surfaces of the file drawer are provided with sliding slots respectively, and the file drawer is slidably disposed in the corresponding file cabinet through the sliding slots.

* * * * *